US008711056B2

(12) United States Patent
Kang et al.

(10) Patent No.: US 8,711,056 B2
(45) Date of Patent: Apr. 29, 2014

(54) MULTI DISPLAY DEVICE AND METHOD OF CONTROLLING THE SAME

(75) Inventors: Im-Soo Kang, Yongin-si (KR); Jae-Goo Lee, Yongin-si (KR)

(73) Assignee: Samsung Electronics Co., Ltd., Suwon-Si, Gyeonggio-Do (KR)

( * ) Notice: Subject to any disclaimer, the term of this patent is extended or adjusted under 35 U.S.C. 154(b) by 2126 days.

(21) Appl. No.: 11/243,797

(22) Filed: Oct. 5, 2005

(65) Prior Publication Data

US 2006/0087477 A1 Apr. 27, 2006

(30) Foreign Application Priority Data

Oct. 21, 2004 (KR) ..... 10-2004-0084220

(51) Int. Cl.
*G09G 5/00* (2006.01)

(52) U.S. Cl.
USPC ..... 345/1.1

(58) Field of Classification Search
USPC ..... 345/1.1
See application file for complete search history.

(56) References Cited

U.S. PATENT DOCUMENTS

2003/0210215 A1* 11/2003 Takahashi ..... 345/87
2004/0222943 A1* 11/2004 Kudo et al. ..... 345/1.1
2005/0052340 A1* 3/2005 Goto et al. ..... 345/1.3

FOREIGN PATENT DOCUMENTS

JP 2004 126257 4/2004
KR 2004 0026163 3/2004

OTHER PUBLICATIONS

English Translation of Chinese Office Action, Mar. 7, 2008.
English Abstract of CN Publication No. CN1595243, Mar. 16, 2005.
English Abstract, Mar. 30, 2004.
English Abstract, Apr. 22, 2004.

* cited by examiner

*Primary Examiner* — Waseem Moorad
(74) *Attorney, Agent, or Firm* — F. Chau & Associates, LLC

(57) ABSTRACT

A multi display device includes a row drive circuit, a column drive circuit and a column line selection circuit. The row drive circuit drives first row lines of a first display panel and second row lines of at least one second display panel. The column drive circuit drives first column lines of the first display panel and second column lines of the second display panel. The column line selection circuit controls a connection between the column drive circuit and one of the first column lines and the second column lines based on a column line selection signal.

15 Claims, 7 Drawing Sheets

MULTI DISPLAY DEVICE AND METHOD OF CONTROLLING THE SAME

CROSS-REFERENCE TO RELATED APPLICATIONS

This application claims priority to Korean Patent Application No. 2004-84220, filed on Oct. 21, 2004, the content of which is hereby incorporated by reference in its entirety.

BACKGROUND OF THE INVENTION

1. Field of the Invention

The present invention relates to a multi display device and a method of controlling the same. More particularly, the present invention relates to a multi display device that includes a drive circuit and a backlight unit shared in common by multiple display panels, which may prevent degradation in display quality such as the occurrence of a ghost image due to a leakage current drawn from an activated display panel.

2. Description of the Related Art

A portable electronic device incorporating a display module may include a main display panel that displays a large amount of text and images and a sub display panel that displays a small amount of text and images. For example, in a mobile device such as a foldable mobile phone, the main display panel may be positioned in an inner surface of a cover of the foldable mobile phone to display the phone number of a caller upon an incoming call, a dynamic image, etc., whereas the sub display panel may be positioned in an outer surface of the cover to display time information, a battery level, etc.

Generally, a camera module incorporated within the mobile device is required to have high performance and display a moving picture. A thin film transistor (TFT) liquid crystal display panel having a relatively high response speed, high resolution and high color reproducibility may be used for the main display panel. On the other hand, a super twisted nematic (STN) liquid crystal display panel or a TFT liquid crystal display panel having a relatively low resolution and low color reproducibility may be used for the sub display panel.

The dual display device may meet the user's need for convenience and achieve a high level of performance. However, in the dual display device, the use of the two display panels may increase both cost and power consumption.

The dual display devices have various configurations with respect to a drive circuit. For example, separate drive circuits may be used to drive the respective display panels independently. In such a case, noise between the display panels may be reduced; however, the use of the separate driving circuits for respective display panels may increase the volume of an application device (e.g., mobile phone) and power consumption.

In another example, a common drive circuit may be used for two display panels to manage the respective resolutions of the two display panels, and the volume of the device may be reduced as a result. Moreover, the common drive circuit is relatively expensive, resulting in increased costs. In still another example, when the main display panel and the sub display panel need not be concurrently driven, a common drive circuit for the main display panel may be shared by the sub display panel, which generally has a relatively lower resolution than the main display panel.

When an image is to be displayed on the main display panel, only the main display panel is driven and the sub display panel is powered off. Similarly, when the image is to be displayed on the sub display panel, only the sub display panel is driven and the main display panel is powered off. Although the use of the common driver chip may result in lower device cost, noise and increased power consumption may occur due to an increase in parasitic capacitance of a wiring line.

To reduce noise and power consumption, the main display panel and the sub display panel may have separate row lines, while sharing common column lines. In the TFT display panel, an output of the row line is applied to a gate terminal of a cell transistor of a pixel so that the row line may also be referred to as a gate line. Similarly, because an output of the column line is applied to a source terminal of the cell transistor of the pixel, the column line may also be referred to as a source line.

FIG. 1 is a schematic view illustrating a dual display device with one driver chip. Referring to FIG. 1, the dual display device includes a sub display panel 110, a main display panel 130, a driver integrated chip (IC) 140, glass substrates 101 and 102 and a flexible printed circuit board (FPCB) 120. As shown in FIG. 1, instead of separate driver ICs for the respective display panels, one driver IC 140 is mounted on the glass substrate 102. The driver IC 140 may be mounted on the glass substrate 102 via a chip-on-glass (COG) technique or using amorphous silicon gate (ASG).

The main display panel 130 and the driver IC 140 are mounted on the glass substrate 102 and the sub display panel 110 is mounted on the glass substrate 101 that is connected with the glass substrate 102 through the FPCB 120. Therefore, to drive both the main display panel 130 and the sub display panel 110 using one driver chip, the main display panel 130 and the sub display panel 110 may share in common the column lines of the driver chip 140. Depending on whether an image is displayed on the main display panel 130 or sub display panel 110, a row drive signal and a column drive signal are controlled to display images on a corresponding display panel.

In the liquid crystal display panel, a backlight unit disposed at a rear of the liquid crystal display panel may be used to display images according to an adjusted light transmittance of liquid crystal. In a multi display device, multi display panels may share a common backlight unit to reduce the overall dimension of the display device and lower costs. For example, in a foldable mobile device employing two display panels, the main display panel may be disposed at an inner side of a folding part of the mobile device and the sub display panel may be disposed at an outer side of the folding part. The backlight unit may be disposed at the folding part and interposed between the main display panel and the sub display panel.

FIG. 2 is a schematic view illustrating a dual display device using a common backlight unit. In FIGS. 1 and 2, like reference numerals refer to similar or identical elements. As shown in FIG. 1, the glass substrate 101 is connected with the glass substrate 102 through the FPCB 120, wherein the main display panel 130 is mounted on the glass substrate 102 and the sub display panel 110 is mounted on the glass substrate 101. Referring to FIG. 2, the sub display panel 110 is rotated 180 degrees so that a rear face of the sub display panel 110 opposes a rear face of the main display panel 130. A backlight unit 150 is interposed between the main display panel 130 and the sub display panel 110. The backlight unit 150 may include a bi-directional light-emitting device so that the light may pass through both the main display panel 130 and the sub display panel 110.

When two display panels share a single driver chip and a single backlight unit, as described above, an output of the driver chip is commonly used for the main display panel and the sub display panel (i.e., column lines for the main display panel are shared by the sub display panel), and a minor amount of leakage current may flow through the sub display panel when a main display panel is activated. The leakage current through the sub display panel may be drawn through a capacitor in the pixel of the sub display panel to change the light transmittance of the pixel so that a ghost image may appear on the sub display panel. When the respective display panels each use a separate backlight unit, in order to display an image on the main display panel so that the ghost image may not appear on the sub display panel, only the backlight for the main display panel is turned on, while the backlight for the sub display panel is turned off.

However, when the backlight is shared in common by the main display panel and the sub display panel, light is transmitted to the sub display panel even when only the main display panel is activated. Therefore, the ghost image due to the leakage current may appear on the sub display panel so that the image will appear distorted to the viewer. Moreover, as described above, noise and increased power consumption may occur due to an increase in parasitic capacitance of a wiring line.

SUMMARY OF THE INVENTION

Exemplary embodiments of the present invention provide a multi display device having a display control circuit for reducing the occurrence of a ghost image in at least one non-activated display panel due to a leakage current from an activated display panel, and for preventing an increase in current consumption due to the use of column lines that are shared in common by the activated display panel and the non-activated display panel.

Exemplary embodiments of the present invention also provide a method of controlling a multi display device for reducing a ghost image and for preventing an increase in current consumption due to the use of common column lines.

According to an exemplary embodiment of the present invention, there is provided a multi display device, which includes a row drive circuit, a column drive circuit, a column line selection circuit. The row drive circuit drives first row lines of a first display panel and second row lines of at least one second display panel. The column drive circuit drives first column lines of the first display panel and second column lines of the second display panel. The column line selection circuit controls a connection between the column drive circuit and one of the first column lines and the second column lines based on a column line selection signal.

In one exemplary embodiment of the present invention, the multi display device may further include a display control circuit, which has a column line selection control unit for generating the column line selection signal to electrically disconnect the second column lines of the at least one second display panel from the common drive circuit when only the first display panel is activated, and the display control circuit controls the row drive circuit and the column drive circuit. The column line selection circuit may include at least one switching element coupled between the column drive circuit and the at least one second display panel, the switching element switching off or on in response to the column line selection signal.

In another exemplary embodiment of the present invention, the multi display device may further include a display control circuit, which has a column line selection control unit for generating the column line selection signal to select one of the first display panel and the at least one second display panel, and the display control circuit controls the row drive circuit and the column drive circuit. The column line selection circuit may include at least one multiplexer that selectively couples one of the first display panel and the at least one second display panel to the column drive circuit.

According to an exemplary embodiment of the present invention, there is provided of a method of controlling a multi display device, which includes receiving a display selection signal for selecting a display panel to be activated; generating a column line selection signal based on the display selection signal; controlling a connection between a column driving signal and one of first column lines of a first display panel and second column lines of at least one second display panel based on the column line selection signal.

BRIEF DESCRIPTION OF THE DRAWINGS

The present invention will become more apparent to those of ordinary skill in the art when descriptions of exemplary embodiments thereof are read with reference to the accompanying drawings, of which.

DETAILED DESCRIPTION OF THE EXEMPLARY EMBODIMENTS

Hereinafter, exemplary embodiments of the present invention will be described in detail with reference to the accompanying drawings.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
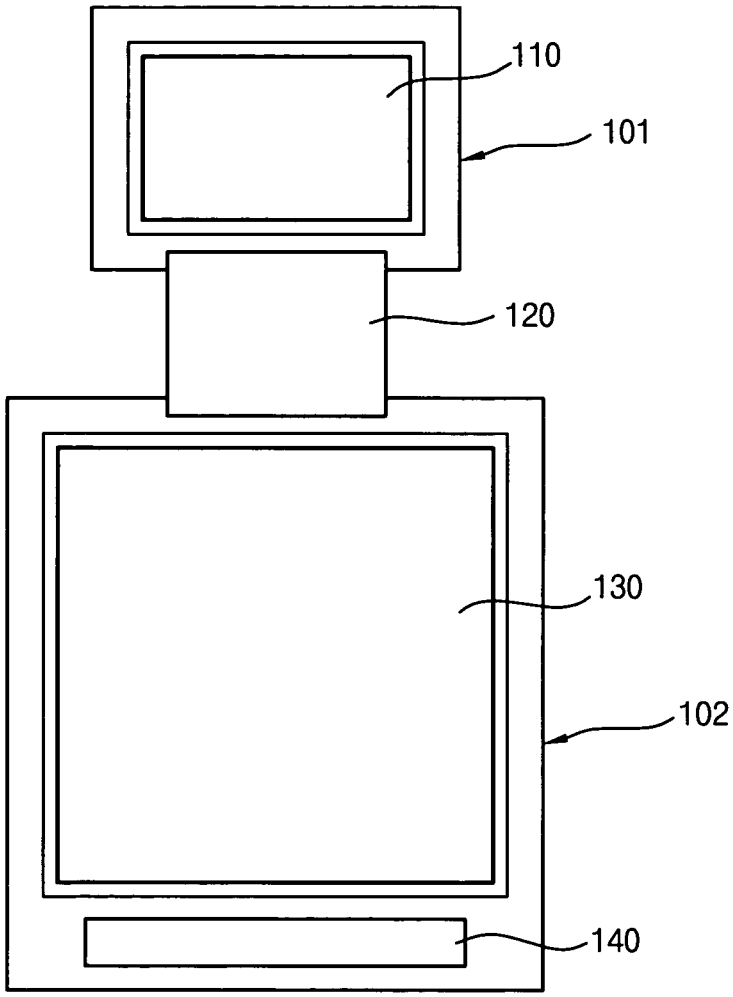
FIG. 1 (RELATED ART)
FIG. 1 is a schematic view illustrating a dual display device with one driver chip.
Figure 2:
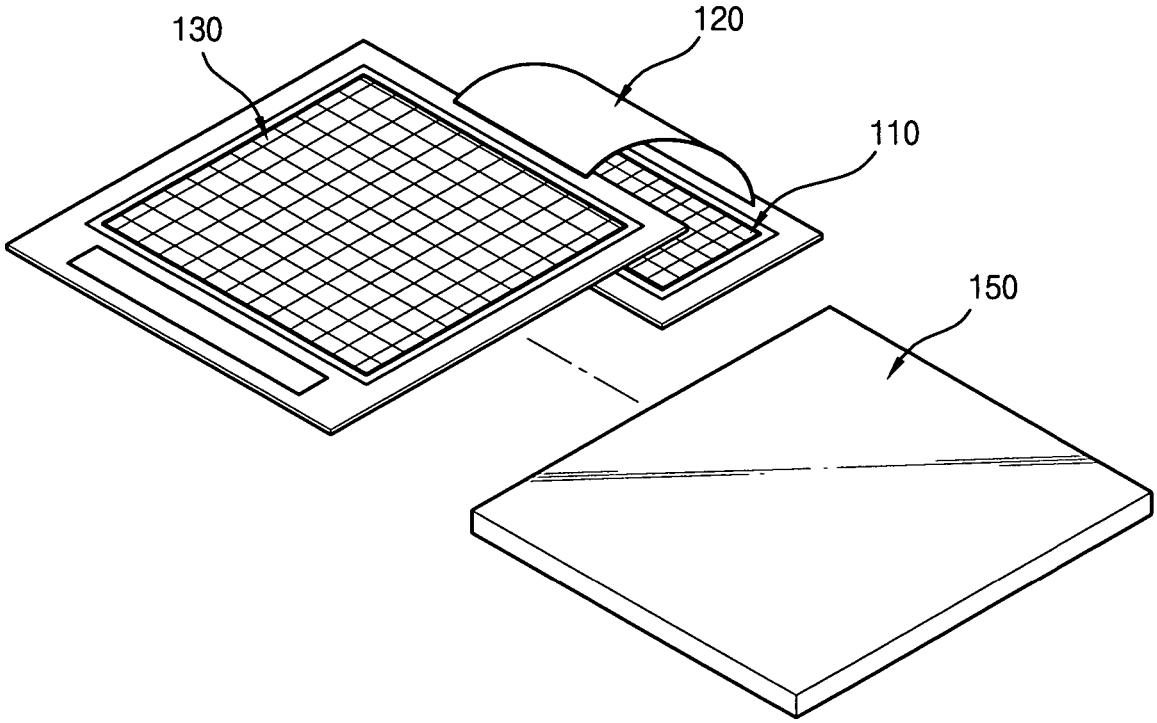
FIG. 2 (RELATED ART)
FIG. 2 is a schematic view illustrating a dual display device using a common backlight unit.
Figure 3:
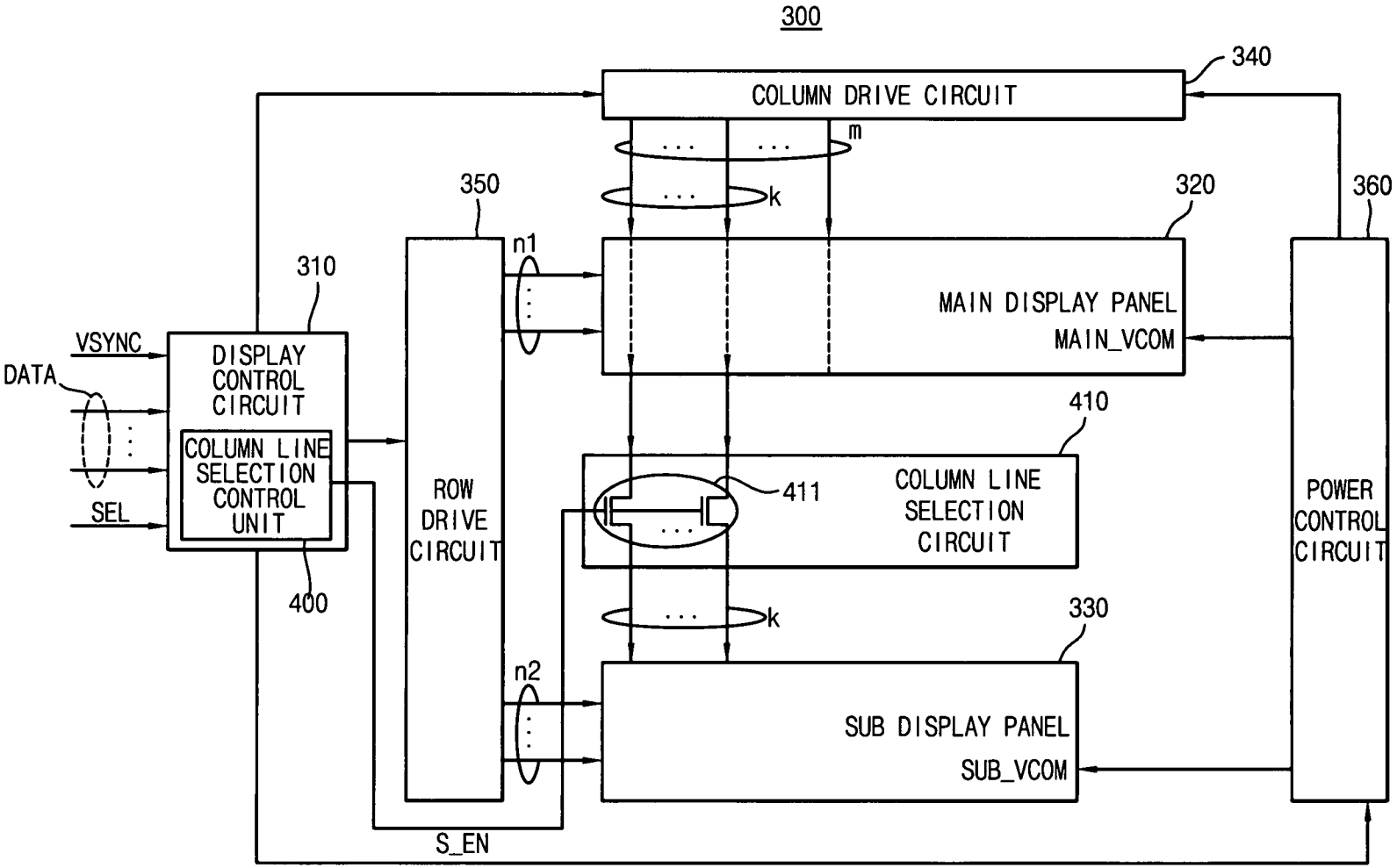
FIG. 3 is a block diagram illustrating a multi display device, according to an exemplary embodiment of the present invention.

FIG. 3 is a block diagram illustrating a multi display device, according to an exemplary embodiment of the present invention. The multi display device shown in FIG. 3 is in a dual display configuration. Alternatively, the multi display device according to embodiments of the present invention may have more than two display panels. Referring to FIG. 3, the multi display device includes a main display panel 320, a sub display panel 330, a display control circuit 310, a column line selection control unit 400, a column line selection circuit 410 and a power control circuit 360. The multi display device may further include a column drive circuit 340 that drives m column lines of the main display panel 320 and k column lines of the sub display panel 330, and a row drive circuit 350 that drives n1 row lines of the main display panel 320 and n2 row lines of the sub display panel 330.

The main display panel 320 and the sub display panel 330 may correspond to a thin film transistor (TFT) liquid crystal display panel or a super-twisted nematic (STN) liquid crystal display panel. When the TFT liquid crystal display panel is used for the main display panel 320 and the sub display panel 330, the column drive circuit 340 may also be referred to as a source drive circuit (or a data drive circuit), and the row drive circuit 350 may also be referred to as a gate drive circuit.

Exemplary embodiments of the present invention provide a multi display device that prevents a ghost image from being generated due to the use of a common backlight unit shared by the main display panel and the sub display panel or from being generated due to a leakage current drawn from an activated display panel to a non-activated sub display panel. Therefore, the processes and apparatus of the present invention may be applied to any type of the display panels where a backlight unit is shared in common and/or a leakage current of an activated display panel may cause the occurrence of a ghost image in a non-activated display panel.

For example, the main display panel 320 may have a resolution of 320×240 and the sub display panel 330 may have a resolution of 160×128.

The row drive circuit 350 may output a row drive signal on 320 row lines (n1=320) of the main display panel 320. Additionally, the row drive circuit 350 may output a row drive signal on 160 row lines (n2=160) of the sub display panel 330. In one embodiment of the present invention, output lines of the main display panel 320 are separate from the output lines of the sub display panel 330. In one embodiment of the present invention, the row drive circuit 350 may have a total of 480 output lines.

The column drive circuit 340 may output a column drive signal on 720 column lines (m2=720) of the main display panel 320. Since a pixel generally includes three sub pixels for R (red), G (green) and B (blue), 720 column lines are required to scan all of the sub pixels (i.e., 240×3=720). Among the 720 column lines of the main display panel 320, 384 column lines (128×3=384) may be used as the column lines for the sub display panel 330 (namely, k is 384). The 384 column lines of the main display panel 320 are shared by the sub display panel 330.

Referring to FIG. 3, the column lines of the main display panel 320 are electrically connected to the column lines of the sub display panel 330 via the column line selection circuit 410 so that a column drive signal outputted from the column drive circuit 340 is transmitted to the sub display panel 340 via the column line selection circuit 410. Such a structure may have a relatively simple interconnection structure.

The column drive circuit 340 and the row drive circuit 350, as shown in FIG. 3, may have various components optimally configured for each display device and each type of display panel. For example, the column drive circuit 340 may include a frame memory, a shift register, a line latch, a level shifter, a source driver, etc.

The display control circuit 310 typically receives an image data DATA provided from an external source, a vertical synchronization signal VSYNC and a horizontal synchronization signal HSYNC to control the row drive circuit 350, the column drive circuit 340 and the power control circuit 360. In an embodiment of the present invention, the display control circuit 310 may receive a display selection signal SEL for selecting one of the main display panel 320 and the sub display panel 330. For example, the display control circuit 310 may determine whether the image data DATA is to be displayed on the main display panel 320 or on the sub display panel 330 based on the display selection signal SEL.

The power control circuit 360 of FIG. 3 provides common electrode voltages MAIN_VCOM and SUB_VCOM to the main display panel 320 and the sub display panel 330, respectively, and provides respective supply voltages to the column drive circuit 340 and row drive circuit 350 upon a control of the display control circuit 310.

The display control circuit 310 has a function of preventing the column drive signal from being provided to the sub display panel in addition to a function of controlling the row drive circuit 350, the column drive circuit 340 and the power control circuit 360. In the multi display device, according to an embodiment of the present invention, the display control circuit 310 may include the column line selection control unit 400 that prevents the column drive signal from being supplied to the sub display panel 330 when the main display panel 320 is activated.

The column line selection control unit 400 controls the column line selection circuit 410 using a column line selection signal S_EN in response to the display selection signal SEL that is externally provided. The column line selection circuit 410 may include switching elements 411 that are connected between common column lines among the column lines of the main display panel 320 and the column lines of the sub display panel 330, respectively. The switching elements 411 may be connected in parallel to one another.

When each of the switching elements 411 includes an NMOS transistor, according to an embodiment of the present invention, the column line selection control unit 400 may inactivate the column line selection signal S_EN (e.g., logic low level) to turn off the switching elements 411 of the column line selection circuit 410 so that only the main display panel 320 is enabled. Therefore, the column lines of the sub display panel 330 may be electrically disconnected from the column drive circuit 340 so that a leakage current of the main display panel 320 may not flow through to the sub display panel 330.

On the other hand, when the sub display panel 330 is to be operated, the column line selection control unit 400 may activate the column line selection signal S_EN (e.g., logic high level) so that the switching elements 411 of the column line selection circuit 410 are turned on in response to the column line selection signal S_EN. Therefore, the column lines of the sub display panel 330 may be connected with the column drive circuit 340 to drive the sub display panel 330.

When each of the switching elements 411 includes a PMOS transistor, the column line selection signal S_EN may be activated (e.g., logic high level) to turn off the switching elements 411 so that only the main display panel 320 is enabled. When the sub display panel 330 is to be operated, the column line selection signal S_EN may be inactivated (e.g., logic low level) to turn on the switching elements 411. Therefore, the column lines of the sub display panel 330 may be electrically disconnected from the column drive circuit 340 when the sub display panel is not operated so that the leakage current from an activated display panel may not flow through the sub display panel 330.

In an embodiment of the present invention, the switching element 411 may also include a CMOS transmission gate, which operates in response to the column line selection signal S_EN and an inverted column line intercepting control signal.

Figure 4:
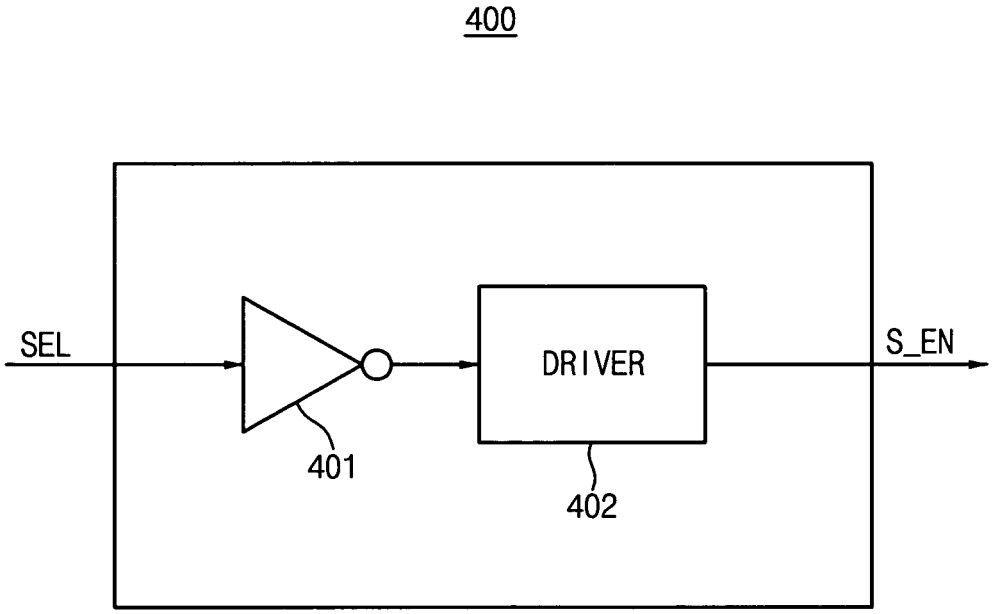
FIG. 4 is a block diagram illustrating a column line control unit of FIG. 3, according to an exemplary embodiment of the present invention.

FIG. 4 is a block diagram illustrating the column line selection control circuit 400 of the display control circuit 310 of FIG. 3, according to an exemplary embodiment of the present invention. The column line selection control circuit 400 receives the display selection signal SEL applied to the display control circuit 310 to generate the column line selection signal S_EN.

The column line selection control circuit 400 may include an inverter 401, as shown in FIG. 4, for generating the column line selection signal S_EN based on the display selection signal SEL. Alternatively, the column line selection control circuit 400 may have other configurations depending upon kinds of the switching elements 411 of the column line selection circuit 410.

Preferably, the switching elements 411 of the column line selection circuit 410 have a high threshold voltage to reduce an influx of a subthreshold conduction current. In one embodiment of the present invention, a driver 402 may be further included in the column line selection control circuit 400 so as to generate the column line selection signal S_EN having a higher voltage level to drive the switching elements 411 having higher threshold voltages.

When the switching element 411 of the column line selection circuit 410 includes the CMOS transmission gate as described above, the column line selection control circuit 400 may further include a second inverter (not shown) to additionally provide the switching elements 411 with an inverted column line selection signal /S_EN.

Figure 5:
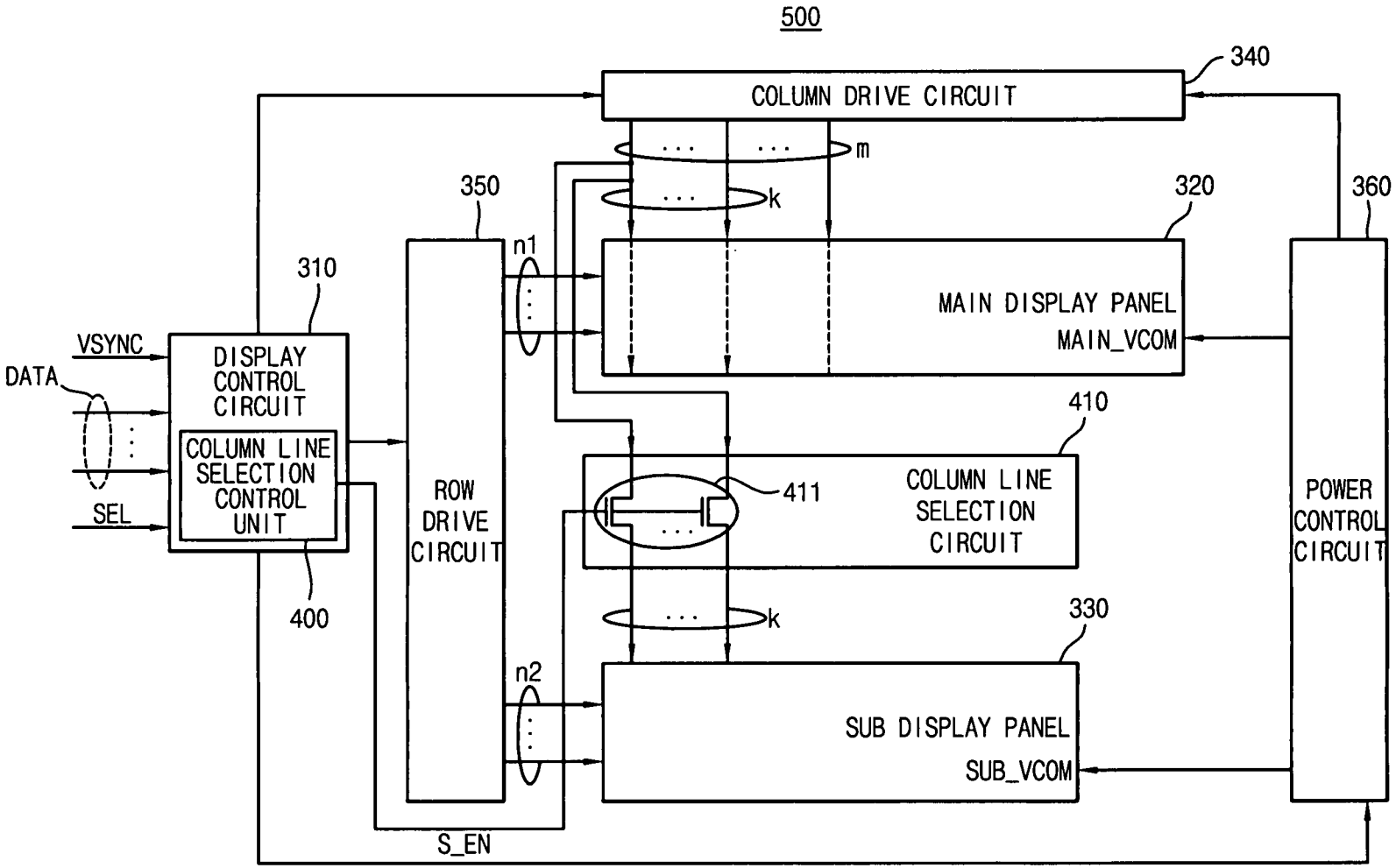
FIG. 5 is a block diagram illustrating a connection configuration of the display device of FIG. 3, according to another exemplary embodiment of the present invention.

FIG. 5 is a block diagram illustrating a connection configuration of the display device of FIG. 3, according to another exemplary embodiment of the present invention. A display device 500 of FIG. 5 has substantially similar or identical elements as those illustrated in FIG. 3. The display device 500 of FIG. 5 differs from the display device of FIG. 3 in that column lines provided from the column drive circuit 340 are not passed through the main display panel 320. For example, the column lines circumvent the main display panel 320 and are connected to the sub display panel 330.

It should be appreciated that the processes and apparatus of example embodiments of FIG. 3 and FIG. 5 may be suitable for applications where the main display panel is not exposed to the user while the sub display panel is being driven (or activated). For example, in the case of a foldable mobile device where the column lines are shared in common by the main display panel and the sub display panel, a sub display panel may be disposed on an outer surface of a folding part of the mobile device and the main display panel may be disposed on an inner surface of the folding part. The main display panel is opposite to the sub display panel.

In a foldable mobile phone, when the mobile phone is folded, the user cannot view the main display panel, so a ghost image caused by the leakage current of the sub display panel is of no concern. However, in some applications where the main display panel may be viewed by the user when the sub display panel is also being driven, it is required to electrically disconnect the common column lines of the main display panel from the column lines of the sub display panel while the sub display panel is being driven, so that the leakage current of the sub display panel may not cause a ghost image to appear on the main display panel. Similarly, it is required to electrically disconnect the common column lines of the sub display panel from the column lines of the sub display panel while the main display panel is being driven.

Figure 6:
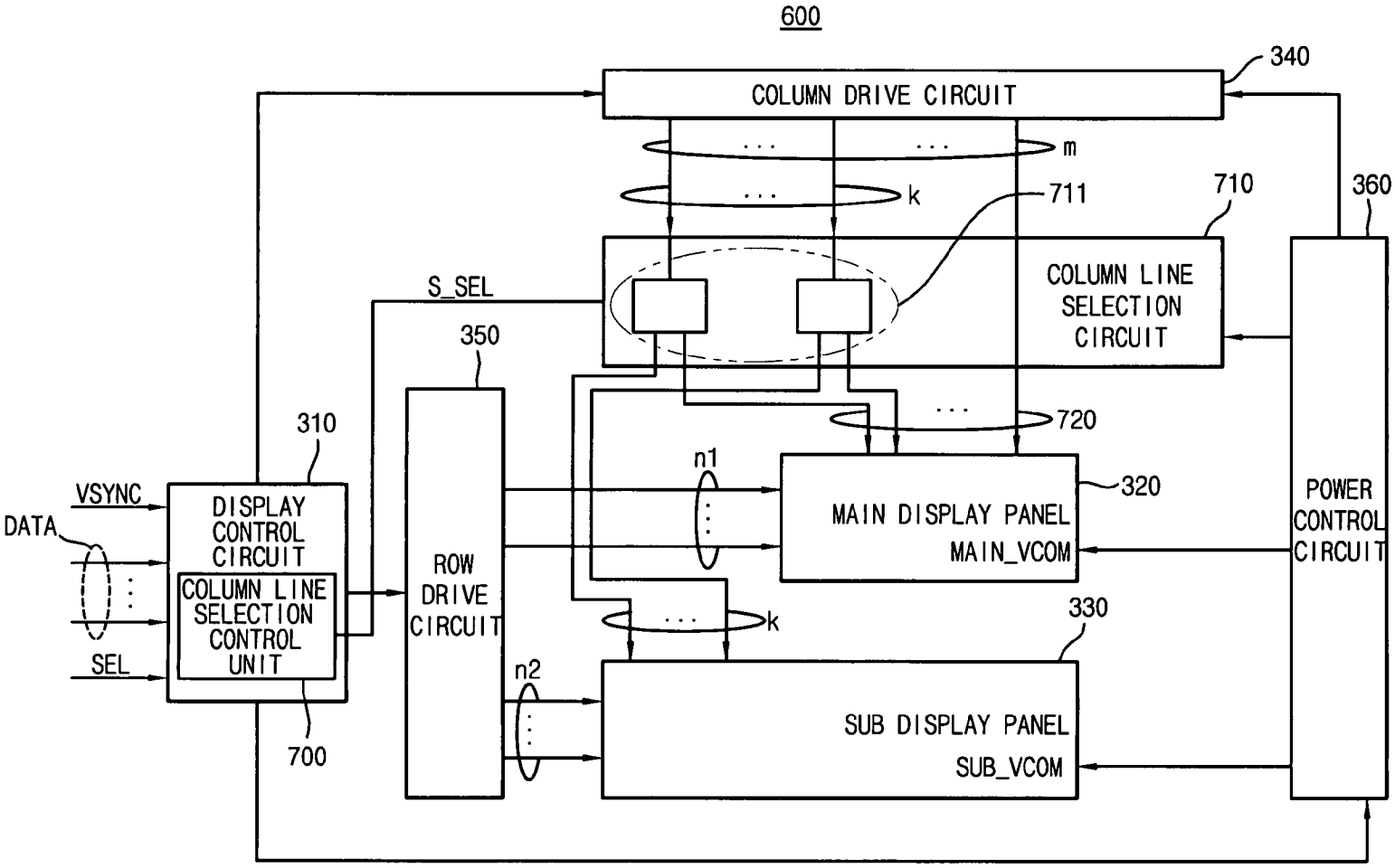
FIG. 6 is a block diagram illustrating a multi display device, according to another exemplary embodiment of the present invention.

FIG. 6 is a block diagram illustrating a multi display device 600, according to another exemplary embodiment of the present invention. In the multi display device 600 in FIG. 6, column lines of the column drive circuit 340 are selectively coupled to the column lines of the main display panel 320 or the column lines of the sub display panel 330. In comparison with the multi display device 300 shown in FIG. 3, the multi display device 600 of FIG. 6 includes a column line selection control unit 700 and a column line selection circuit 710, instead of the column line selection control unit 400 and column line selection circuit 410.

The column line selection control unit 700 may receive the display selection signal SEL inputted to the display control circuit 310 to generate the column line selection signal S_SEL. The column line selection circuit 710 of FIG. 6 may include multiplexers 711 that selectively connect the column lines of the column drive circuit 340 to either the main display panel 320 or the sub display panel 330.

The multiplexers 711 of the column line selection circuit 710, according to an embodiment of the present invention, may be implemented using switching devices having high threshold voltage to reduce an influx of the leakage current (or subthreshold conduction current) as described above with respect to the display device of FIG. 3. Similar to the display device of FIG. 4, a driver may be included in the column line selection control unit 700 so as to generate the column line selection signal S_SEL having a higher voltage level to drive the multiplexers 711 having higher threshold voltage.

Figure 7A:
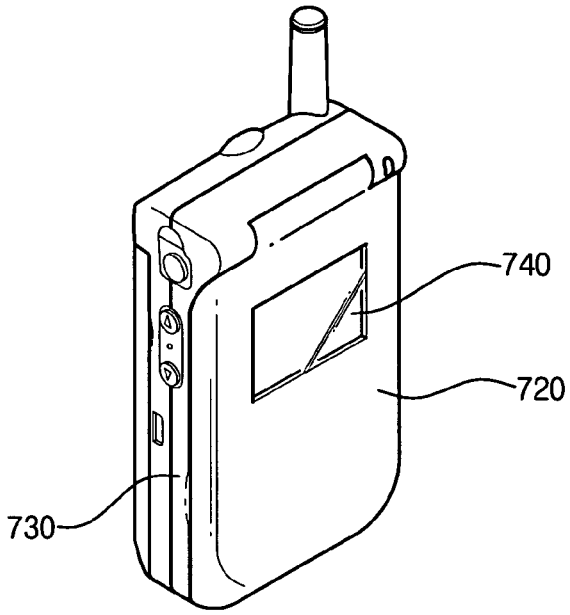
FIGS. 7A and 7B are perspective views illustrating a mobile communication terminal incorporating a multi display device, according to an exemplary embodiment of the present invention.
Figure 7B:
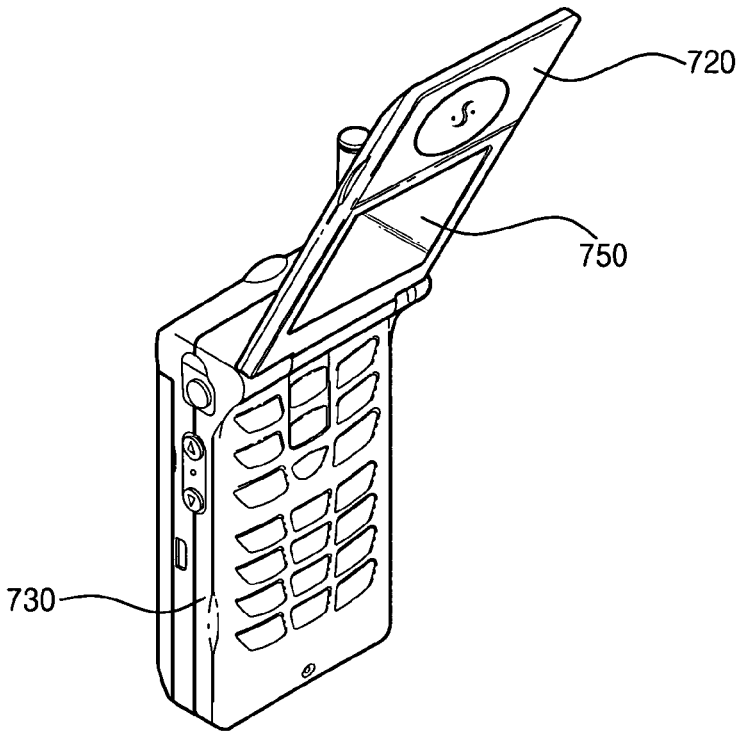

FIGS. 7A and 7B are perspective views illustrating a mobile communication device including a multi display device, according to an exemplary embodiment of the present invention. Referring to FIGS. 7A and 7B, the mobile communication device may include a folding part 720 and a body part 730, wherein the folding part 720 is foldable (and/or rotatable) relative to the body part 730.

In FIG. 7A, the folding part 720 is shown in a closed position (i.e., the mobile phone is folded) and a sub display panel 740 is mounted on an outer surface of the folding part 720. In FIG. 7B, the folding part 720 is in an open position (i.e., the mobile phone is unfolded), and a main display panel 750 is mounted on an inner surface of the folding part 720.

As shown in FIGS. 7A and 7B, the main display panel 750 and the sub display panel 740 are disposed on the folding part 720, being opposite to each other. A common backlight may be disposed between the main display panel 750 and sub display panel 740.

In a foldable mobile phone, when the folding part 720 is in the closed position as shown in FIG. 7A, the main display panel 750 may be turned off and the sub display panel 740 may be turned on. As the mobile phone is folded, the ghost image caused by the leakage current of the sub display panel 740 on the main display panel 750 is of no concern because the user cannot view the main display panel.

Conversely, when the folding part 720 is in the open position as shown in FIG. 7B, the main display panel 750 is turned on and the sub display panel 740 is is turned off. In this case, the ghost image of the main display panel 750 may appear in the sub display panel 740 by the backlight unit disposed at the rear of the sub display panel 740.

In accordance with an embodiment of the present invention, the column line selection control unit 400 of the display control circuit 310 may provide the column line selection circuit 410 with the column line selection signal S_EN to electrically disconnect the column line of the column drive circuit 340 from the sub display panel 740. Alternatively, the column line selection control unit 700 of the display control circuit 310 may provide the column line selection circuit 710 of FIG. 7 with the column line selection signal S_SEL to electrically disconnect the column line of the column drive circuit 340 from the sub display panel 740.

According to the exemplary embodiments of the present invention, in the multi display device where a common backlight unit is shared by at least two display panels, degradation in display image quality such as the occurrence of a ghost image due to a leakage current from an activated display panel may be prevented.

In addition, when the column lines of the column drive circuit are shared in common by at least two display panels, the column lines may be electrically disconnected from a non-activated display panel so that the load of the column lines of the column drive circuit may be maintained constant, resulting in a reduction of current consumption and improvement in driving performance.

Although the processes and apparatus of the present invention have been described in detail with reference to the accompanying drawings for the purpose of illustration, it is to be understood that the inventive processes and apparatus are not to be construed as limited thereby. It will be readily apparent to those of reasonable skill in the art that various modifications to the foregoing exemplary embodiments may be made without departing from the scope of the invention as defined by appended claims.

What is claimed is:

1. A multi display device comprising:

a display control circuit, receiving a display selection signal, and according to the display selection signal generating a column line selection signal for selecting one of a first display panel and at least one second display panel to activate;

a row drive circuit configured to drive first row lines of the first display panel and second row lines of the at least one second display panel;

a column drive circuit having column lines that branch into first column lines that provide data to the first display panel and that branch into second column lines that provide data to the second display panel; and a column line selection circuit configured to control, based upon the column line selection signal, a branching connection between the column drive circuit and one of the second column lines that circumvent the first display panel such that data is provided to the second display panel, wherein the column line selection circuit is external to the first display panel and to the second display panel.

2. The multi display device of claim 1, wherein the column line selection circuit electrically disconnects the second column lines of the at least one second display panel from the column drive circuit when only the first display panel is activated, and the display control circuit controlling the row drive circuit and the column drive circuit.

3. The multi display device of claim 2, further comprising a backlight unit disposed between the first display panel and the second display panel.

4. The multi display device of claim 2, wherein the row drive circuit separately drives the first row lines of the first display panel and the second row lines of the second display panel.

5. The multi display device of claim 2, wherein a portion of the first column lines are shared in common by the at least one second display panel, a number of the shared first column lines corresponding to a number of the second column lines of the second display panel.

6. The multi display device of claim 2, wherein the column line selection control unit generates the column line selection signal by amplifying a voltage level of the display selection signal or an inverted display selection signal.

7. The multi display device of claim 2, wherein the column line selection circuit includes at least one switching element coupled between the column drive circuit and the at least one second display panel, the switching element switching off or on in response to the column line selection signal.

8. The multi display device of claim 1, further comprising a display control circuit having a column line selection control unit for generating the column line selection signal to select one of the first display panel and the at least one second display panel, and the display control circuit controlling the row drive circuit and the column drive circuit.

9. The multi display device of claim 8, wherein the column line selection circuit includes at least one multiplexer that selectively couples one of the first display panel and the at least one second display panel to the column drive circuit.

10. A method of controlling a multi display device, comprising:

providing a column drive circuit to commonly drive first column lines of a first display panel and the second column lines of at least one second display panel;

providing a column line selection circuit external to the first display panel and to the second display panel for electrically disconnecting the second column lines from the column drive circuit when only the first display panel is activated;

receiving a display selection signal for selecting a display panel to be activated;

generating a column line selection signal based on the display selection signal; and driving one of the first column lines of the first display panel and the second column lines of the at least one second display panel based on the column line selection signal, wherein the column drive circuit comprises column lines that branch into the first column lines that provide data to the first display panel and that branch into the second column lines that provide data to the second display panel, and wherein based upon the column line selection signal, a branching connection is made between the column drive circuit and one of the second column lines that circumvent the first display panel such that data is provided to the second display panel.

11. The method of claim 10, wherein the first column lines are shared in common by the at least one second display panel as many as a number of the second column lines of the second display panel.

12. The method of claim 10, wherein the step of driving one of the first column lines and the second column lines based on the column line selection signal further comprising: driving the first display panel and electrically disconnecting the driving signal from the at least one second display panel based on the display selection signal.

13. A mobile device having the multi display device according to claim 1.

14. The mobile device of claim 13, wherein the mobile device corresponds to a folder-type mobile phone and the first display panel is disposed at an inner surface of a folding part of the mobile phone and the second display panel is disposed at an outer surface of the folding part.

15. The mobile device of claim 13, wherein the first display panel is activated when the folding part of the mobile terminal is unfolded.

* * * * *